US011724906B2

(12) United States Patent
Zoske

(10) Patent No.: US 11,724,906 B2
(45) **Date of Patent: *Aug. 15, 2023**

(54) HOSE REEL SYSTEMS

(71) Applicant: Ag Premier, Inc., Iowa Falls, IA (US)

(72) Inventor: Mick Zoske, Iowa Falls, IA (US)

(73) Assignee: Ag Premier, Inc., Iowa Falls, IA (US)

( * ) Notice: Subject to any disclaimer, the term of this patent is extended or adjusted under 35 U.S.C. 154(b) by 136 days.

This patent is subject to a terminal disclaimer.

(21) Appl. No.: 17/124,642

(22) Filed: Dec. 17, 2020

(65) Prior Publication Data

US 2021/0139270 A1 May 13, 2021

Related U.S. Application Data

(63) Continuation of application No. 15/761,204, filed as application No. PCT/US2016/052477 on Sep. 19, 2016, now Pat. No. 10,870,554.

(60) Provisional application No. 62/220,808, filed on Sep. 18, 2015.

(51) Int. Cl.
*B65H 75/42* (2006.01)
*B65H 75/44* (2006.01)

(52) U.S. Cl.
CPC ..... *B65H 75/425* (2013.01); *B65H 75/4402* (2013.01); *B65H 75/4407* (2013.01); *B65H 75/4478* (2013.01); *B65H 75/4489* (2013.01); *B65H 2701/33* (2013.01)

(58) Field of Classification Search
CPC ..... B65H 75/425; B65H 75/4402; B65H 75/4407; B65H 75/4478; B65H 75/4489; B65H 2701/33
See application file for complete search history.

(56) References Cited

U.S. PATENT DOCUMENTS

| | | | | |
|---|---|---|---|---|
| 4,148,445 | A * | 4/1979 | Reynolds | B65H 75/4407 242/397.2 |
| 4,196,917 | A * | 4/1980 | Oakes | A01D 67/005 172/324 |
| 4,767,073 | A * | 8/1988 | Malzacher | B65H 54/54 242/598.3 |
| 6,932,294 | B1 * | 8/2005 | Larson | B65H 57/14 242/397.3 |
| 10,870,554 | B2 * | 12/2020 | Zoske | B65H 75/425 |
| 2008/0302902 | A1 * | 12/2008 | Puck | A01C 23/008 242/390 |
| 2008/0302903 | A1 * | 12/2008 | Puck | A01C 23/008 242/388.6 |
| 2009/0218106 | A1 * | 9/2009 | Stukey | E21B 43/128 166/77.2 |
| 2014/0077020 | A1 * | 3/2014 | Puck | B65H 75/4489 242/390 |
| 2018/0257904 | A1 * | 9/2018 | Zoske | B65H 75/4478 |

* cited by examiner

*Primary Examiner* — Sang K Kim
(74) *Attorney, Agent, or Firm* — Brownwinick Law Firm; David Breiner

(57) ABSTRACT

In accordance with example embodiments a hose reel system including a layout guide is provided.

19 Claims, 13 Drawing Sheets

HOSE REEL SYSTEMS

CROSS REFERENCE TO RELATED APPLICATIONS

This application is a continuation of U.S. patent application Ser. No. 15/761,204 which was filed with the United States Patent and Trademark Office on Mar. 19, 2018 which in turn is a 371 of international PCT/US16/52477 which was filed Sep. 19, 2016, which also claims the benefit of U.S. Patent Application No. 62/220,808 filed on Sep. 18, 2015 with the United States Patent and Trademark Office, the entire contents of which are herein incorporated by reference.

BACKGROUND

1. Field of the Invention

Example embodiments relate to hose reel systems. In example embodiments, the hose reel systems may include a layout guide allowing hose to be laid on the ground offset from a hose reel of the hose reel system. In example embodiments, the hose reel systems may include a moving guide on a front of a hose reel frame to ensure a hose is evenly wound on a hose reel.

2. Description of the Related Art

Hose reel systems are used to lay out and remove hose from a field. Generally, these systems are pulled by a tractor or some other type of vehicle. Conventional hose reels typically include a large spool coupled to a wheeled frame. These spools are often connected to a mechanical system configured to rotate the spool. It is general practice to lay out hose by first attaching it to a stationary object, for example, a pump configured to pump liquid manure. The vehicle then pulls the hose reel system. As the hose reel system is pulled, the hose unwinds from the spool and lays out on an agricultural field. Removing the hose generally involves coupling one end of the hose to the hose reel and activating the mechanical system to rotate the spool to gather the hose.

SUMMARY OF THE INVENTION

Applicant has noticed several problems with conventional hose reel systems. One such problem is the placement of the hose reel system with respect to a vehicle towing it. Generally speaking, conventional hose reel systems are arranged directly behind a towing vehicle making them difficult to observe while hose is being laid down. In addition, hose can generally only be laid down in a region of the ground that coincides with a width of the spool around which the hose is wrapped. In many systems, it is not possible to lay hose outside this area. Furthermore, some conventional hose reel systems are required to be "wobbled" while hose is being wound onto the hose reel in order to promote an even wrapping of the hose on the hose reel. This "wobbling" can adversely affect various components of the hose reel system. Applicant set out to solve these problems. The result is a new and inventive hose reel system that does not suffer the above drawbacks.

Example embodiments are directed to hose reel systems. In at least one nonlimiting example embodiment, a hose reel system includes a frame, an axle rotationally attached to the frame, a pair of wheels attached to the axle, a spool rotationally attached to the frame, a driving member attached to the frame and configured to rotate the spool, a tongue pivotally attached to the frame, and a first actuator configured to pivot the tongue with respect to the frame, wherein the tongue has a first end pivotally connected to the frame and a second end with a coupling member configured to couple the tongue to a towing vehicle. In this nonlimiting example embodiment, the hose reel system may further include a hose guide attached to the frame, wherein the hose guide is configured to move in a side-to-side manner to control a loading of hose on the spool. In this nonlimiting example, the hose guide may be arranged at a front of the hose reel system so that the hose guide is generally between the coupling member and the spool. In this nonlimiting example, the hose reel system may further include a layout guide allowing the hose reel system to lay hose in an area not directly behind the spool.

BRIEF DESCRIPTION OF THE DRAWINGS

Example embodiments are described in detail below with reference to the attached drawing figures, wherein.

DETAILED DESCRIPTION

Figure 1A:
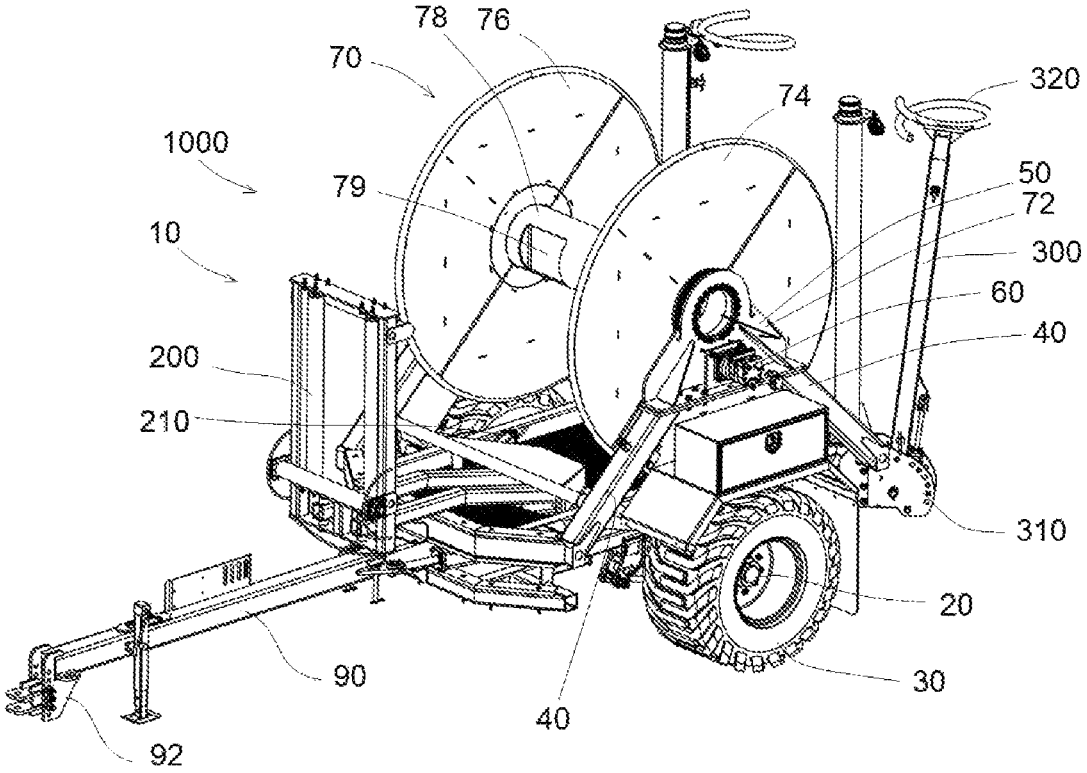
FIG. 1A is a view of a hose reel system in accordance with example embodiments.

Example embodiments will now be described more fully with reference to the accompanying drawings. Example embodiments are not intended to limit the invention since the invention may be embodied in different forms. Rather, example embodiments are provided so that this disclosure will be thorough and complete, and will fully convey the scope of the invention to those skilled in the art. In the drawings, the sizes of components may be exaggerated for clarity.

In this application, when an element is referred to as being "on," "attached to," "connected to," or "coupled to" another element, the element may be directly on, directly attached to, directly connected to, or directly coupled to the other element or may be on, attached to, connected to, or coupled to any intervening elements that may be present. However, when an element is referred to as being "directly on," "directly attached to," "directly connected to," or "directly coupled to" another element or layer, there are no intervening elements present. In this application, the term "and/or" includes any and all combinations of one or more of the associated listed items.

In this application, the terms first, second, etc. are used to describe various elements and components. However, these terms are only used to distinguish one element and/or component from another element and/or component. Thus, a first element or component, as discussed below, could be termed a second element or component.

In this application, terms, such as "beneath," "below," "lower," "above," "upper," are used to spatially describe one element or feature's relationship to another element or feature as illustrated in the figures. However, in this application, it is understood that the spatially relative terms are intended to encompass different orientations of the structure. For example, if the structure in the figures is turned over, elements described as "below" or "beneath" other elements would then be oriented "above" the other elements or features. Thus, the term "below" is meant to encompass both an orientation of above and below. The structure may be otherwise oriented (rotated 90 degrees or at other orientations) and the spatially relative descriptors used herein interpreted accordingly.

Example Embodiments are illustrated by way of ideal schematic views. However, example embodiments are not intended to be limited by the ideal schematic views since example embodiments may be modified in accordance with manufacturing technologies and/or tolerances.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to improved hose reel systems.

Figure 1B:
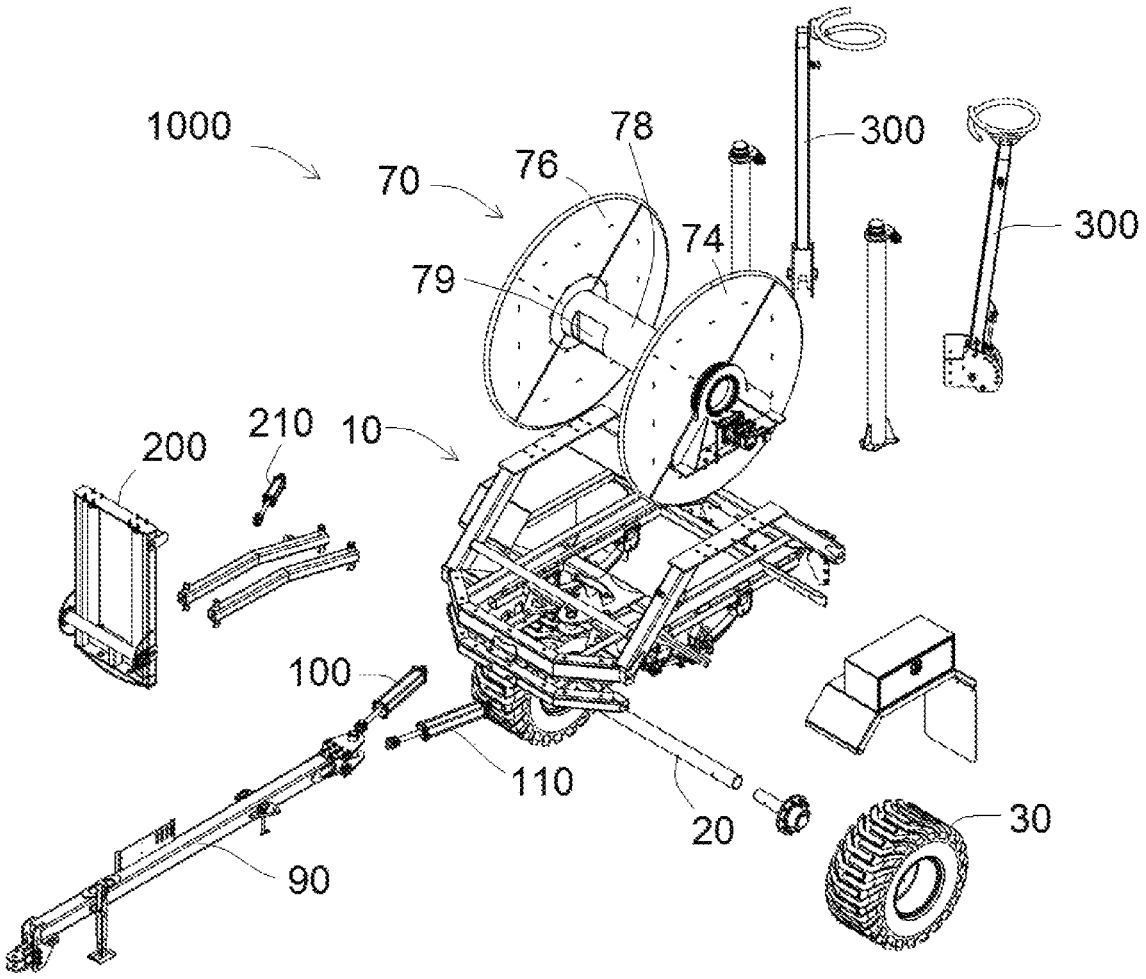
FIG. 1B is an exploded view of the hose reel system in accordance with example embodiments.
Figure 1C:
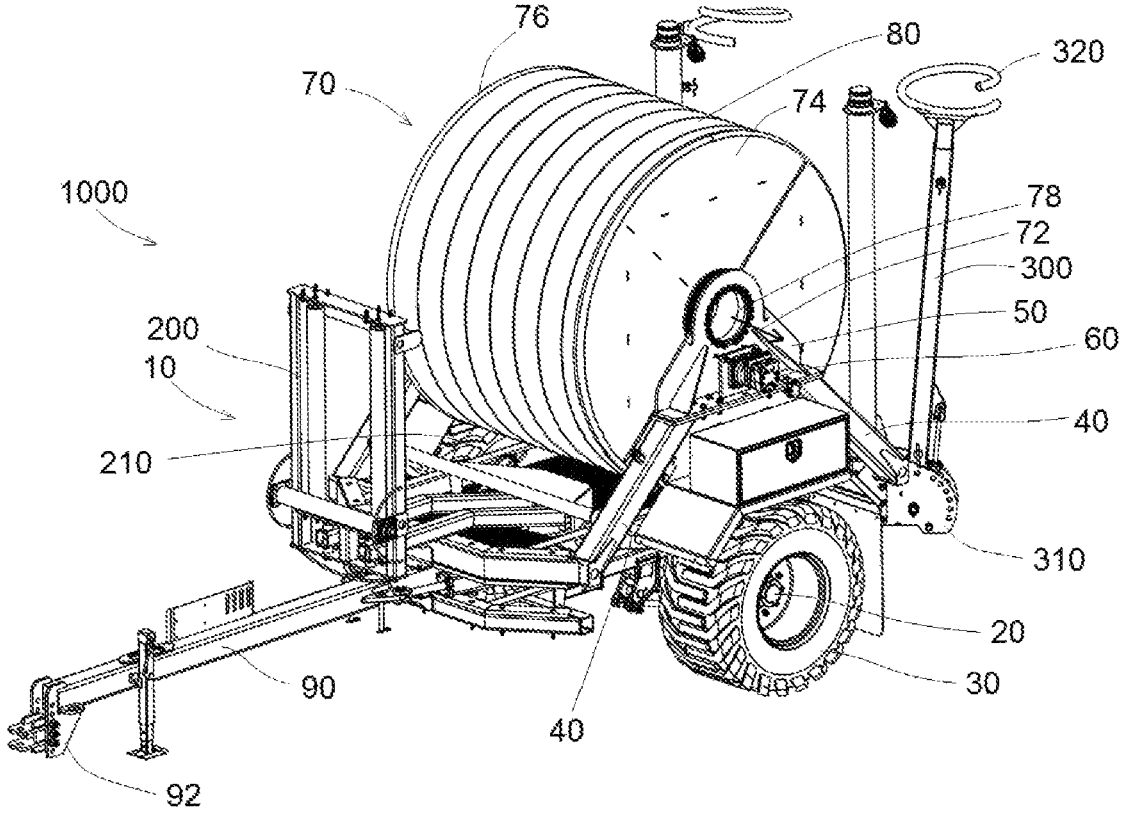
FIG. 1C is a view of the hose reel system with hose wrapped around a spool in accordance with example embodiments.

FIG. 1A is a view of a hose reel system 1000 in accordance with example embodiments. FIG. 1B is an exploded view of the hose reel system 1000 in accordance with example embodiments. FIG. 1C is a view of the hose reel system 1000 carrying a hose 80 in accordance with example embodiments. As shown in FIGS. 1A, 1B, and 1C, the hose reel system 1000 may include a frame 10 to which at least one axle 20 may be journaled. In example embodiments, the hose reel system 1000 may further include a pair of wheels 30 coupled to the axle 20. The axle 20 may be coupled to the frame 10 by a conventional means, such as, but not limited to, leaf springs.

In example embodiments the frame 10 may include pairs of arms 40 which may support intermediate support members 50. In example embodiments, the intermediate support members 50 may support a spool 70 which may be journaled to the intermediate support members 50. In example embodiments, at least one of the intermediate support members 50 may also support a driving member 60. In example embodiments the driving member 60 may be a motor, for example, an electric or hydraulic motor, which may operatively attach to the spool 70 by a connecting member such as a chain or a slewing ring (see FIGS. 7A and 7B). Thus, the driving member 60 may be configured to rotate the spool 70. In example embodiments the driving member 60 may be a reversible motor, as such, the spool 70 may rotate about an axis 72 in either a clockwise or counterclockwise direction depending on how the driving member 60 is controlled. Furthermore, the driving member 60 may be variable speed motor, for example, a two speed motor, allowing for a fast roll up and layout of a hose 80 while giving an operator better control over the hose 80.

In example embodiments the spool 70 may include a first end 74 and a second end 76 coupled to each other by a sleeve 78. In example embodiments the first end 74 and the second end 76 may be configured to capture a hose 80 which may be between the first and second ends 74 and 76. The first end 74 and the second end 76 may, in one embodiment, resemble a ring with spokes, to capture the hose 80. However, the invention is not limited thereto as the first end 74 and the second end 76 may resemble a disk, for example an annular disk, or a combination of a disk and a ring with spokes. Regardless, the purpose and function of the first and second ends 74 and 76 is to retain the hose 80, as such, the particular shape is not important.

In example embodiments the hose reel system 1000 may be connected to a pulling vehicle, for example, a tractor, by a tongue 90. The pulling vehicle may serve at least two purposes. First, the pulling vehicle may be used to move the hose reel system 1000 from one location to another. Second it may include hydraulic lines usable by the hose reel system 1000. For example, the hose reel system 1000 may include hydraulic lines which may be coupled to additional hydraulic lines (not pictured) on/in the hose reel system 1000 which may connect to the driving member 60 in the event the driving member 60 is a hydraulic motor. Thus, the pulling vehicle may provide hydraulic pressure to power the driving member 60.

In example embodiments the tongue 90 may be pivotally attached to the frame 10. For example, the tongue 90 may be pivotally attached to a structural member of the frame 10. In one embodiment, the tongue 90 may be pivotally attached to the frame 10 in a manner to allow the tongue 90 to pivot in a substantially horizontal plane.

In example embodiments the hose reel system 1000 may further include at least one actuator to pivot the tongue. For example, in the embodiment of FIGS. 1A-1C the hose reel system 1000 includes a pair of actuators 100 and 110 to pivot the tongue 90 with respect to the frame 10. The actuators 100 and 110, by way of example, may be hydraulic and/or pneumatic cylinders wherein one end of the cylinders is attached to the frame 10 and another end of the cylinders 100 and 110 is attached to the tongue 90. Thus, by properly controlling the actuators 100 and 110, the tongue 90 may be controllably pivoted with respect to the frame 10. Of course, as is obvious from the figures, the tongue 90 may include a coupling member 92 configured to couple the tongue 90 to a towing vehicle, for example, a tractor.

In example embodiments the system 1000 may further include a hose guide 200 attached to the frame 10. The hose guide 200 may be manipulated on the frame 10 and may be controlled by a user to ensure a hose 80 is properly wound on the spool 70. The hose guide 200, for example, may resemble two parallel bars extending from the frame 10 and the hose 80 may be guided between the parallel bars. In example embodiments the hose guide 200 may be moved back and forth to ensure the hose 80 is evenly wound on the spool 70. In example embodiments the hose guide 200 may be moved back and forth under the influence of an actuator 210, for example, a hydraulic cylinder, or another type of actuator, for example a rack and pinion system, which, when actuated, causes the hose guide 200 to pivot with respect to the frame 10.

Figure 2A:
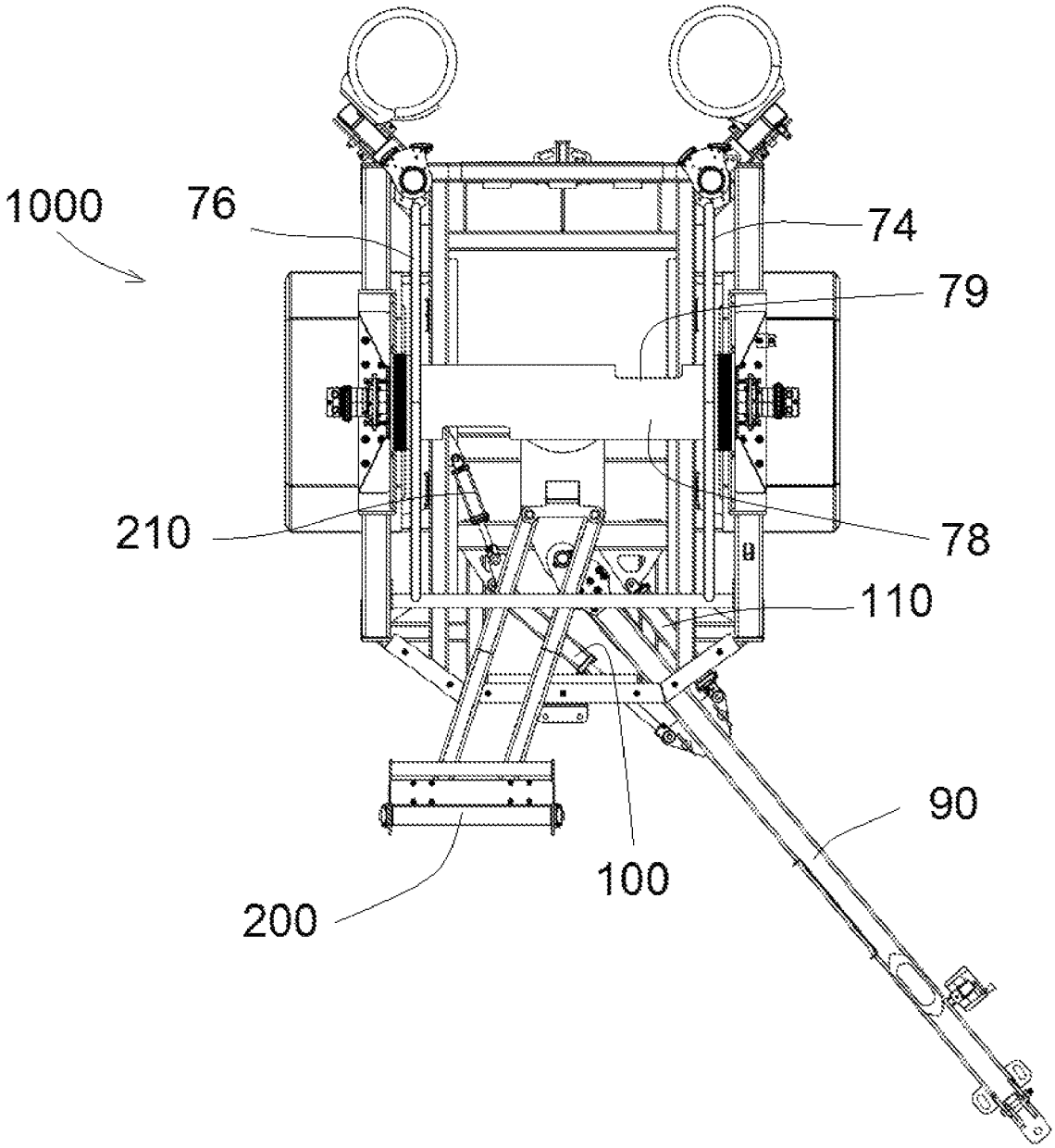
FIGS. 2A and 2B are views of the hose reel system in accordance with example embodiments.
Figure 2B:
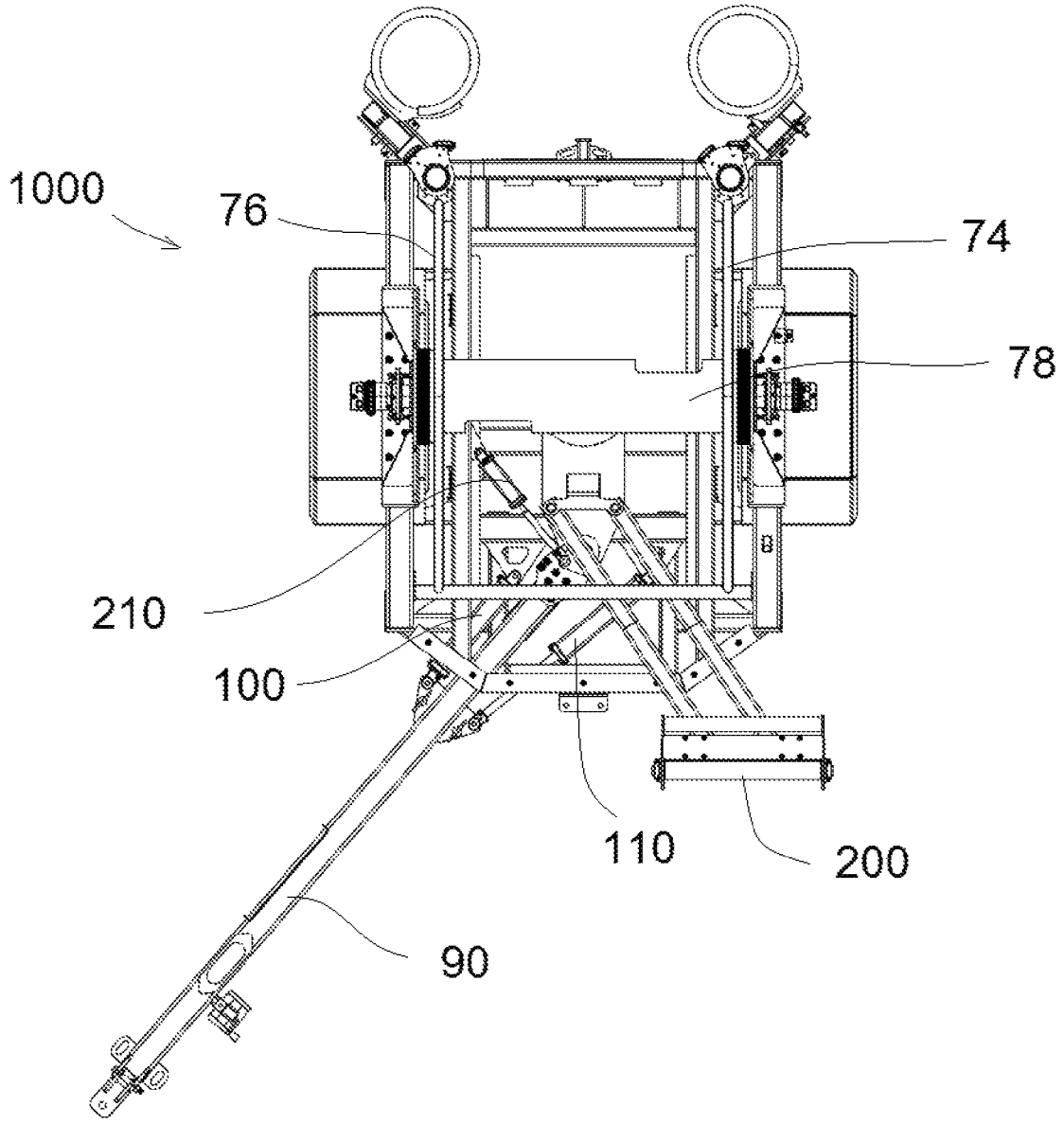

FIG. 2A illustrates the tongue 90 and the hose guide 200 in a first position. In example embodiments the position of the tongue 90 may be controlled by the pair of actuators 100 and 110 whereas the position of the guide 200 may be controlled by the actuator 210. In FIG. 2A the tongue 90 is pivoted to a right most position by extending a length of the actuator 100 and retracting a length of the actuator 110. In FIG. 2B the tongue 90 is pivoted to the left by extending the length of the actuator 110 and retracting a length of the actuator 100. In FIG. 2A the hose guide 200 is positioned at a left side of the spool 70 by retracting a length of the actuator 210. However, extending a length of the actuator 210 will cause the hose guide 200 to move to the right as shown in FIG. 2B. As such, each of the tongue 90 and hose guide 200 may be positioned in various positions by controlling the actuators 100, 110, and 210.

When it is desired to operate the hose reel system 1000, the hose 80 may be provided through a hole 79 in the sleeve 78 of the spool 70. The driving member 60 may then be actuated to rotate the spool 70 to wind the hose 80 around the spool 70. When the hose 80 is being wound around the spool 70 while the hose reel system 1000 is stationary or moving, it may be desirable to feed the hose 80 back and forth across the spool 70 to insure an even winding around the spool 70. This back and forth feeding may be accomplished by feeding the hose through the hose guide 200 which may be moved back and forth under the influence of the actuator 210. One distinguishing feature of the hose guide 200 from the conventional art is its placement. Most conventional hose reel systems that include a hose guide position the hose guide on a back of the hose reel system and the hose is rolled from a back of the hose reel system. However, in example embodiments, the hose guide 200 is arranged at a front of the hose reel system 1000 allowing hose to roll onto the spool 70 via the front of the hose reel system 1000 rather than from a back of the hose reel system 1000. In this way, an operator sitting in a towing vehicle can see position of the hose guide 200 while the hose 80 is being wound on the spool 70. In this application, a front of a hose reel system 1000 is the side of the hose reel system 1000 that is near a pulling vehicle when the pulling vehicle is attached to the hose reel system 1000. A back of the hose reel system 1000 is the side of the hose reel system that is away from the pulling vehicle when the pulling vehicle is attached to the hose reel system 1000.

Once the hose 80 has been provided around the spool 70, the hose reel system 1000 may be transported to a field where it is desired to lay the hose 80 to supply a product, for example, liquid manure, to the field. The hose 80 may be partially unwound from the spool 70 and secured in some manner, such as via connection to a liquid manure pump. The pulling vehicle may then used to pull the hose reel system 1000 across an agricultural field. As the hose reel system 1000 is being pulled, the operator may disengage the driving member 60 so the spool 70 moves freely.

In one embodiment, as the pulling vehicle pulls the hose reel system 1000, an operator may actuate the actuators 100 and 110 to cause the tongue 90 to pivot relative to the frame 10 of the hose reel system 1000. The operator may, for example, control the actuators 100 and 110 in a manner that causes the spool 70 to feed the hose 80 more evenly.

To gather the hose 80, the end of the hose 80 may be positioned through the hole 79 in the sleeve 78 of the spool 70, and the driving device 60 may be actuated to rotate the spool 70. The pulling vehicle and/or hose reel system 1000 may then be driven over the hose 80 laying in the field. The operator may then actuate the actuators 100 and 110 to move the tongue 90 back and forth to pivot the spool 70 back and forth to evenly wind the hose 80 around the spool 70 or may simply cause the hose guide 200 to move back and forth to ensure an even winding.

Figure 3A:
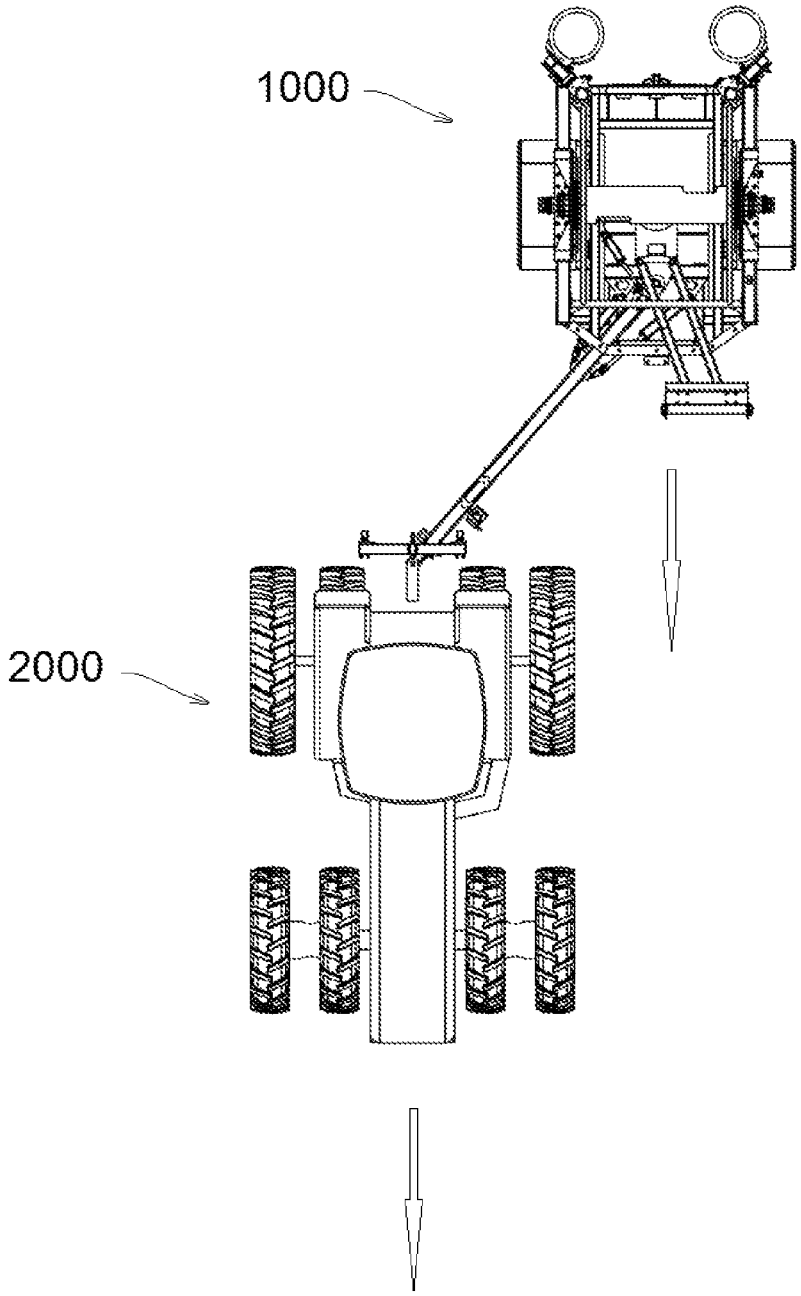
FIGS. 3A and 3B are views of a hose reel system being pulled by a vehicle in accordance with example embodiments.
Figure 3B:
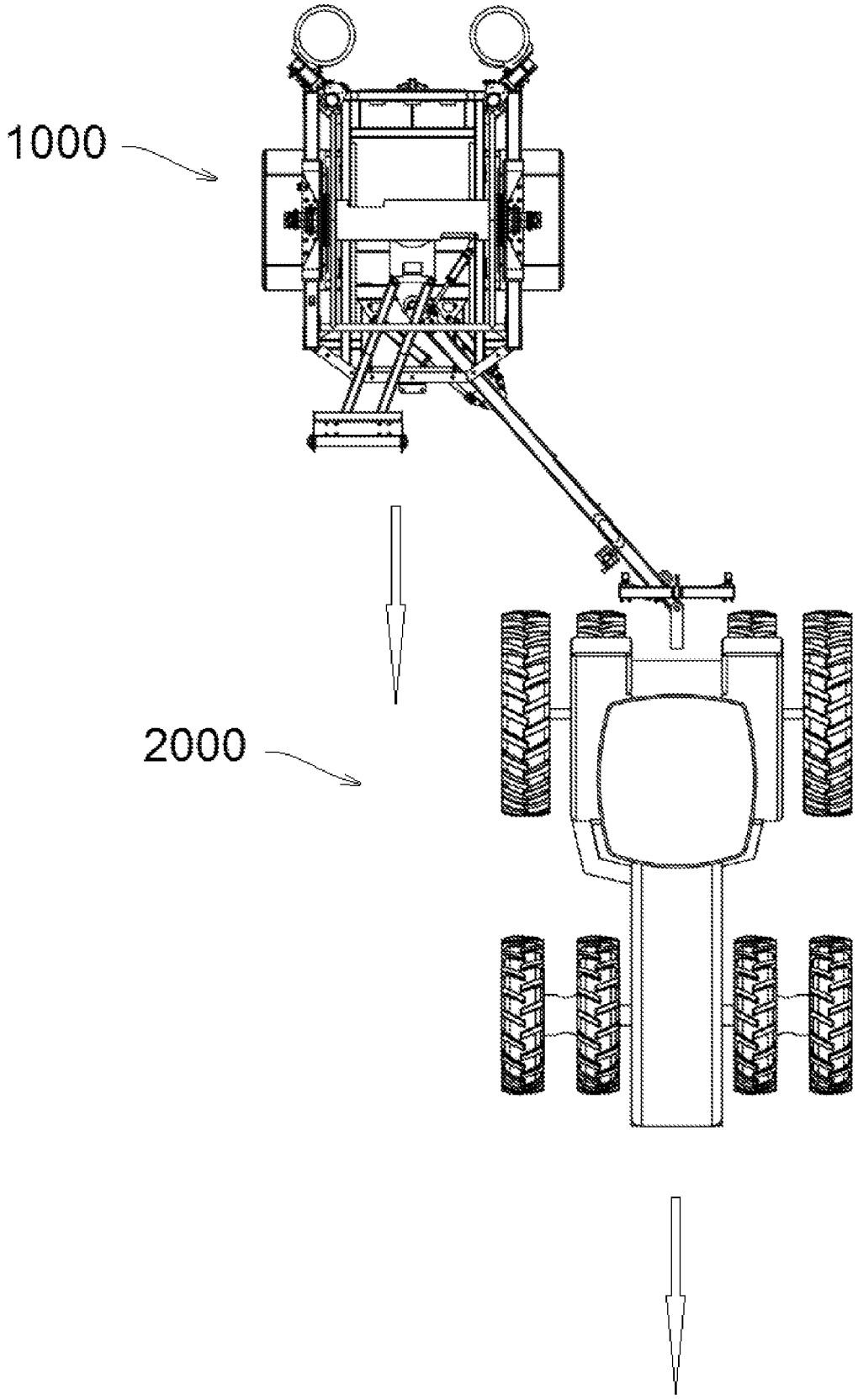

FIGS. 3A and 3B show an advantage of the hose reel system 1000. In FIG. 3A the hose reel system 1000 is illustrated as being pulled by a pulling vehicle 2000 which may be, but is not required to be, a tractor. In example embodiments the actuators 100 and 110 are controlled so that the tongue 90 is pivoted to one side of the hose reel system 1000. With the tongue 90 pivoted the pulling vehicle 2000 may be operated so that the direction of the pulling vehicle 2000 and the hose reel system 1000 are substantially in the same direction except so that the path of travel of each of the pulling vehicle 2000 and the hose reel system 1000 are offset from one another as shown in FIG. 3A. The path of the hose reel system 1000, for example, may be offset to a point outside of an area defined by the wheels 2100 of the pulling vehicle 2000. This has several advantages over the prior art. For example, in the prior art hose reel systems are generally pulled directly behind the pulling vehicle 2000 and hoses are generally wound around the back side of the hose reel system. As a consequence, an operator of a conventional hose reel system is unable to view a hose as it is being wound onto the hose reel system. However, since the hose reel system 1000 of example embodiments may be operated in a manner in which in a path of the hose reel system 1000 is offset from a path of the pulling vehicle 2000 (for example, the tongue 90 may allow for the entire spool 70 to be pulled in an area outside of the tractor duals 2100), and because the hose reel system 1000 allows the hose to wind onto the spool 70 from a front of the hose reel system 1000, the operator has a substantially unobstructed view of the hose 80 as it is being wound onto the spool 70. Other advantages include giving an operator better control of the hose reel system 1000, giving an operator an option to pull the hose reel system 1000 in a forward direction as fittings come through taking tension off of the hose 80 and reducing damage to the hose 80. Furthermore, when an operator has to drive towards the hose when rolling they are driving forward through obstacles and not backing up as would be required with prior art hose reel systems. Also, as evident from FIG. 4B, the actuators 100 and 110 may be controlled to swing the hose reel system 1000 to another side of the pulling vehicle 2000, the advantages thereof being the same as described above.

Figure 4A:
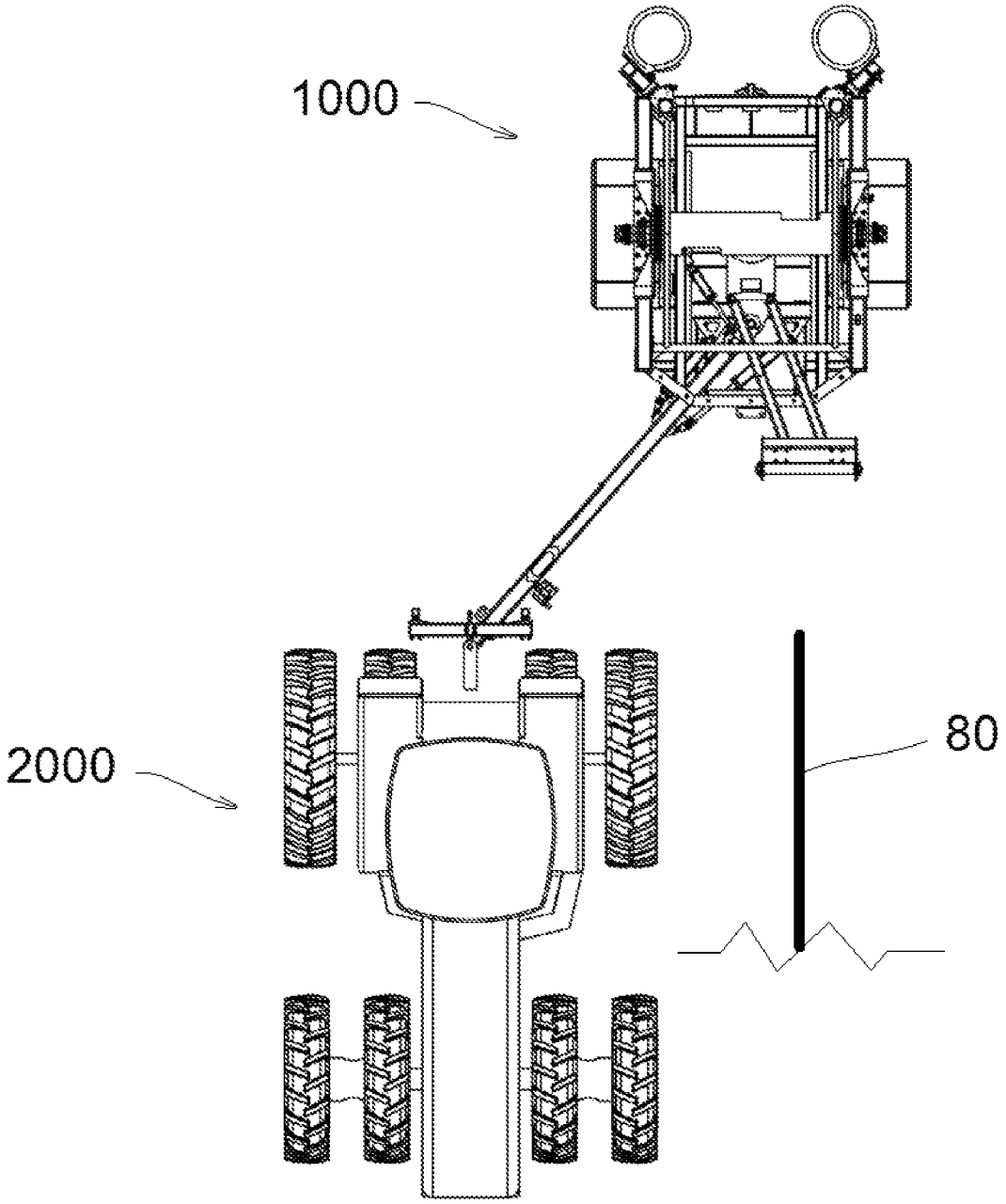
FIGS. 4A-4C illustrates views of a method of collecting hose in accordance with example embodiments.
Figure 4B:
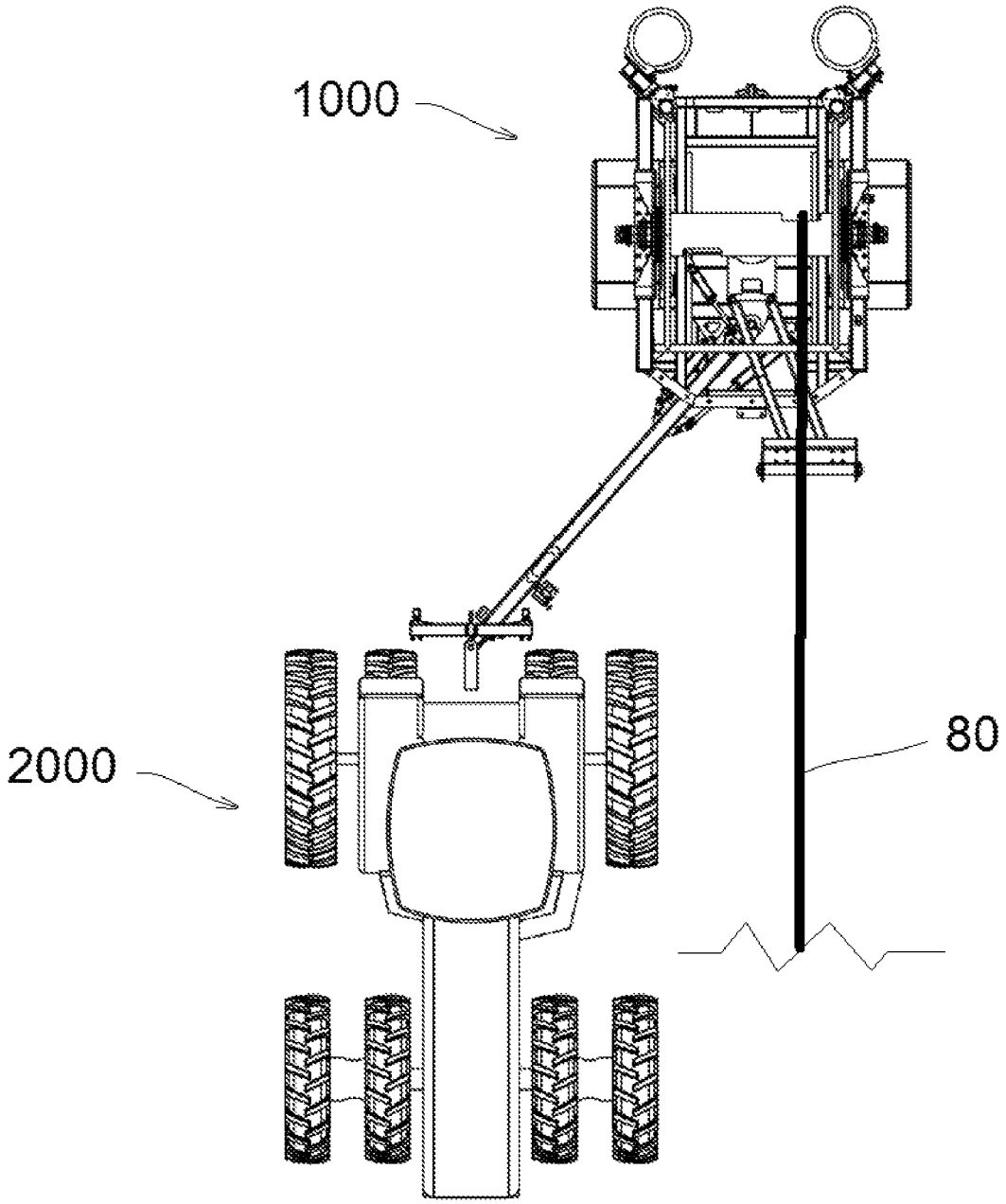
Figure 4C:
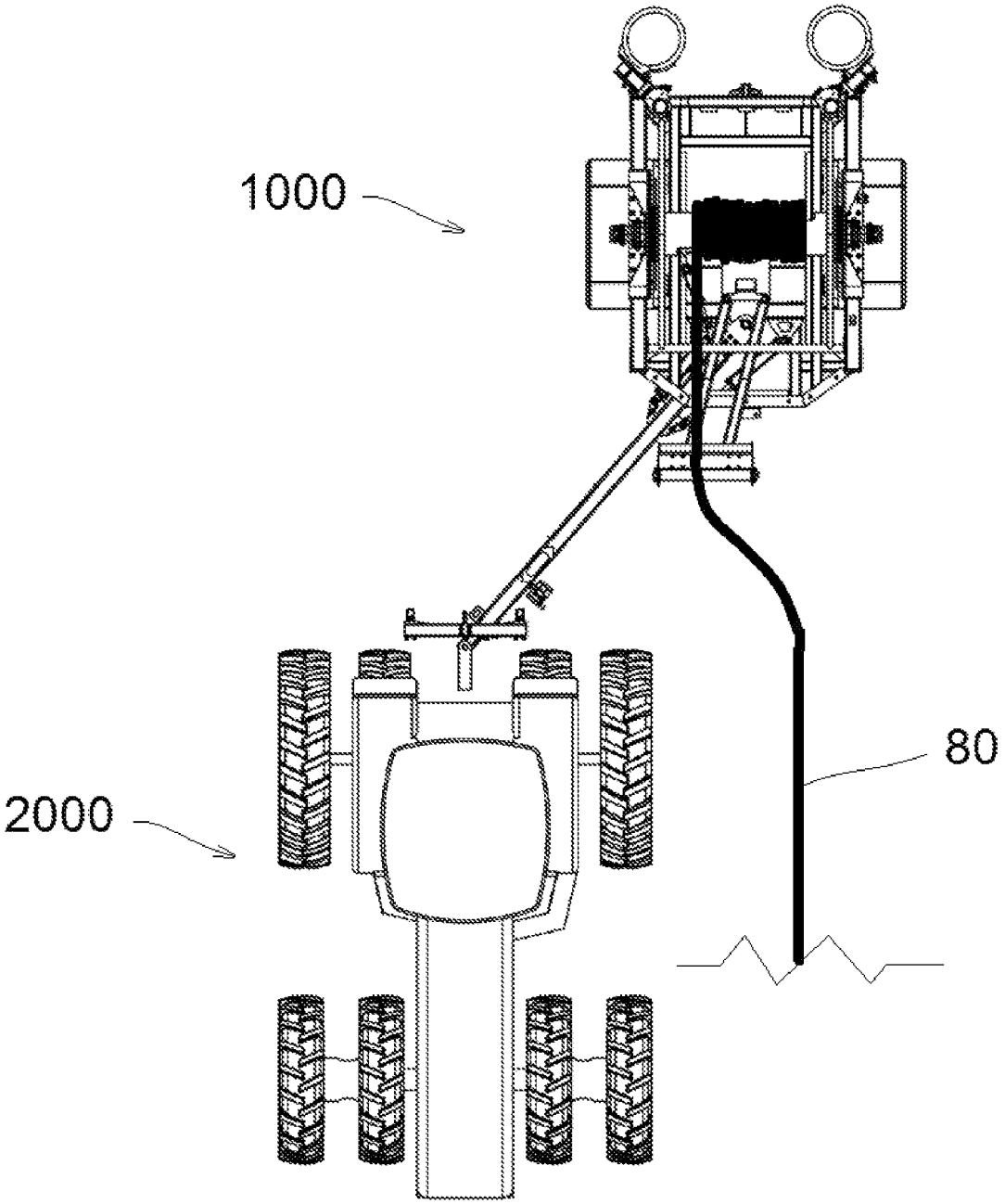

FIGS. 4A-4C illustrate a method of collecting hose in accordance with example embodiments. As shown in FIGS. 4A-4C a hose 80 may be laying on a ground and an operator may drive a vehicle 2000, for example, a tractor, to the hose with the hose reel system 1000 in tow. An end of the hose 80 may be placed through the hose guide 200 and attached to the spool 70 (see FIG. 4B). The vehicle 2000 may then be driven forward while the spool 70 is rotated under the influence of the driving member 60. In this example, the hose guide 200 may be moved back and forth as the hose 80 is wound on the spool 70 to ensure the hose 80 is properly wound on the spool 70.

Figure 5A:
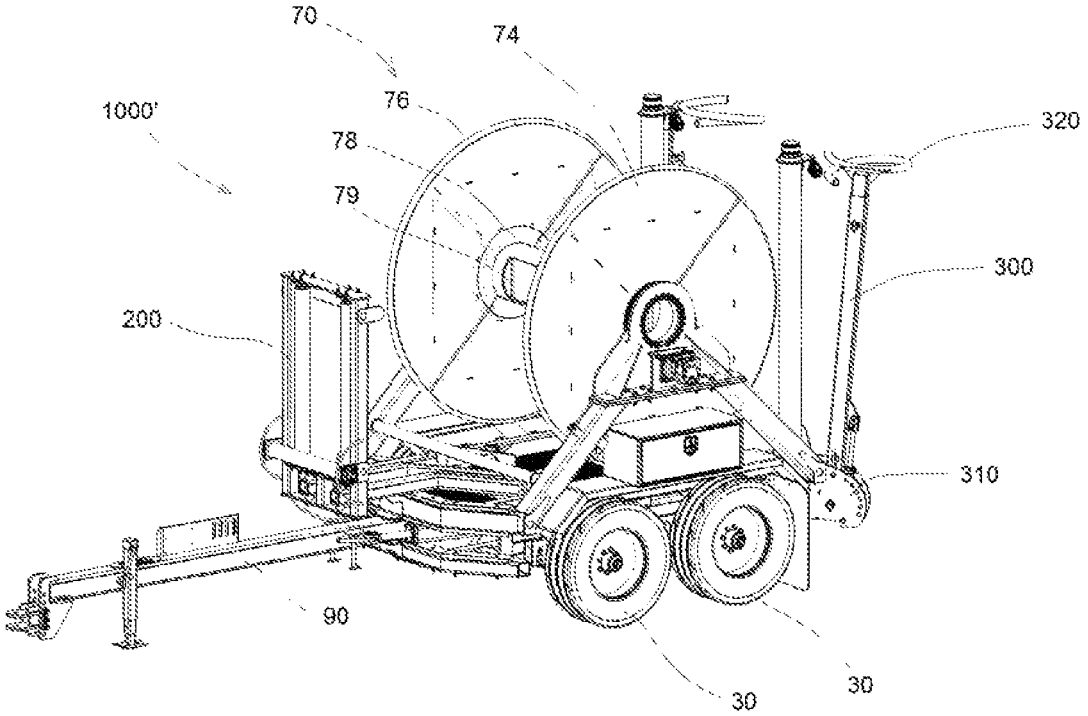
FIG. 5A is a view of a hose reel system in accordance with example embodiments.
Figure 5B:
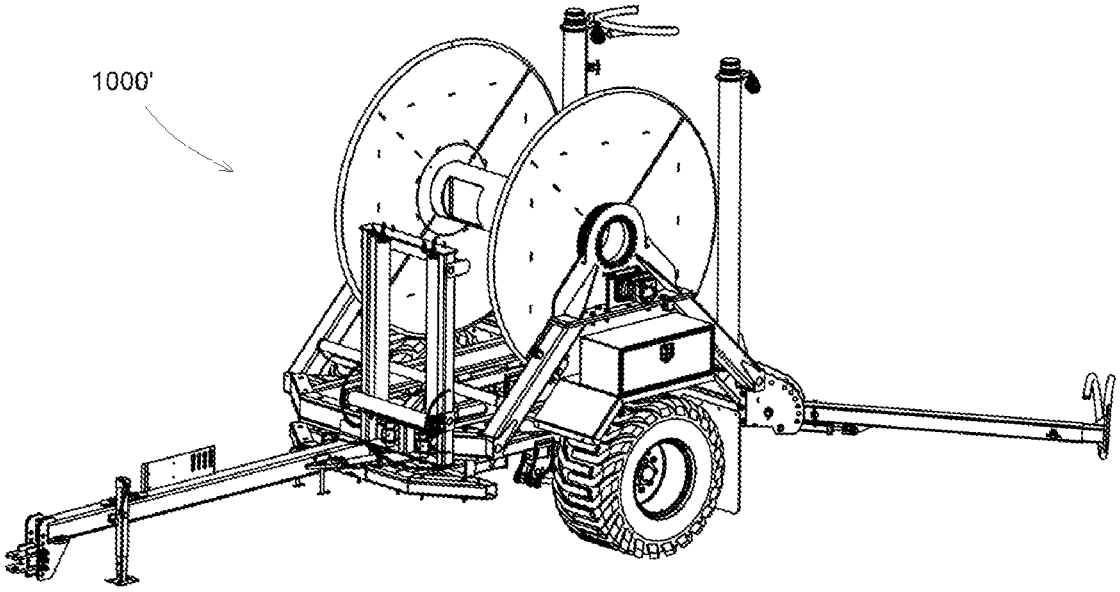
FIG. 5B is another view of the hose reel system in accordance with example embodiments.

FIG. 5 is a view of another hose reel system 1000' in accordance with example embodiments. The system 1000' may be similar to the system 1000 in several respects. For example, the system 1000' includes a frame to which a tongue 90 is pivotally attached. Like the tongue 90 of system 1000, the tongue 90 may be positioned by controlling a pair of actuators that may have one end attached to the frame and another end attached to the tongue 90. The system 1000' may also include a hose guide 200 which may be similar to the hose guide 200 of system 1000 and the hose guide 200 of system 1000' may be controlled in a manner similar to that of the hose guide 200 of system 1000. The system 1000' of FIG. 5, however, includes two pairs of wheels journaled to a frame unlike the system 1000 which includes only one pair of wheels.

Figure 6:
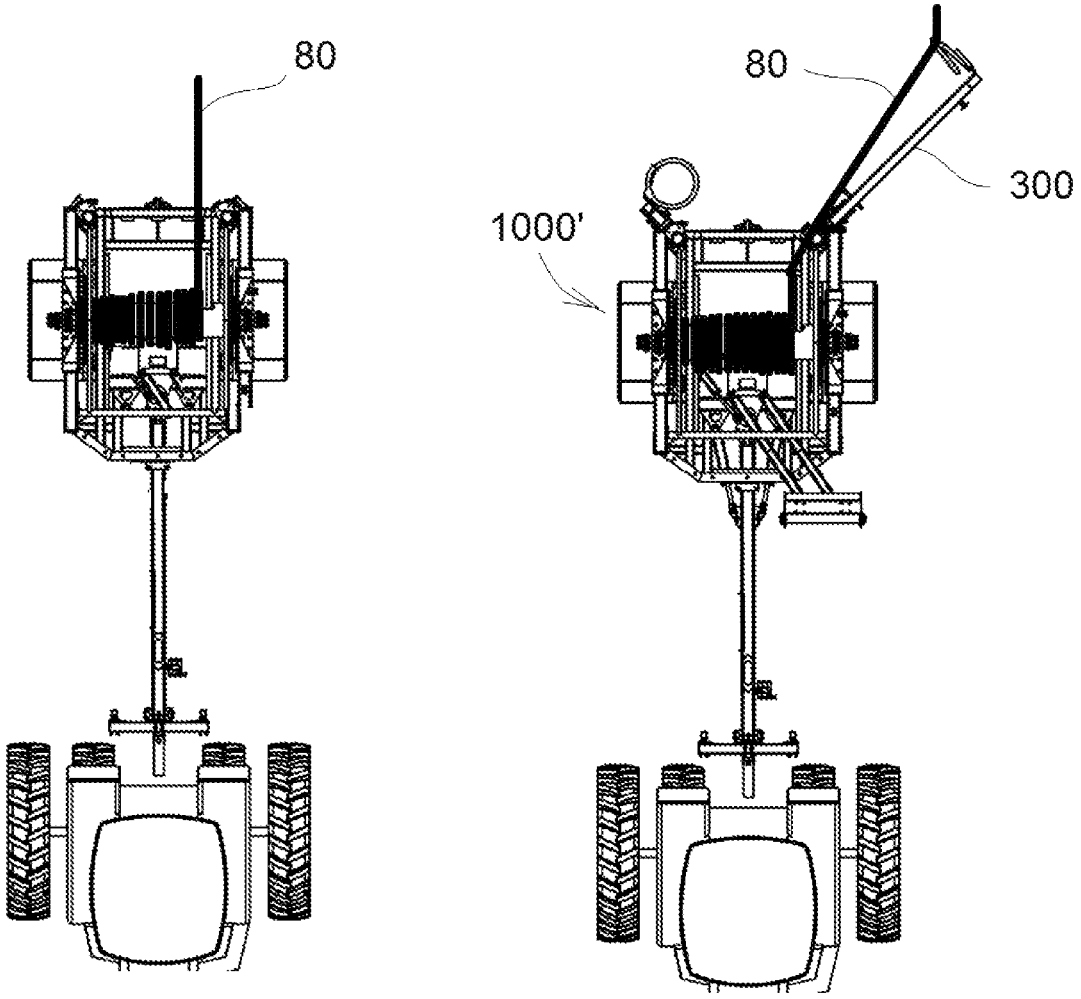
FIG. 6 is a view of a conventional hose reel system and a hose reel system in accordance with example embodiments each laying hose on the ground.

In example embodiments, each hose reel system 1000 and 1000' may include a layout guide 300 extending from the frame 10. As shown in FIG. 5A, the layout guide 300 may resemble a boom extending from the frame which may be pivoted with respect to the frame 10 of the hose reel systems 1000 and 1000'. For example, an end 310 of the layout guide 300 may be pin connected to the frame to allow the layout guide 300 to pivot. The position of the layout guide 300 may be controlled by an actuator that may be, but is not required to be, a hydraulic or pneumatic cylinder. Controlling the actuator may allow a user to properly position the layout guide 300. In the alternative, the hose guide 300 may be manipulated manually and secured in a position using a pin type restraint. Also, the layout guide 300 may include a capture member 320 through which a hose 80 may be fed. An advantage of the hose reel systems 1000 and 1000' with the layout guide 300 clearly lies in the ability of the hose reel systems 1000 and 1000' to lay hose reel in a position that is offset from the spools 70 of the hose reel systems 1000 and 1000'. By allowing a hose to be laid out in an offset manner, an operator can have full view of the hose 80 as it is being laid out without having a view obstructed by the hose reel 70 or any other portion of the hose reel systems 1000 and 1000'. FIG. 6, for example, illustrates a difference between a conventional hose reel system and the hose reel system 1000'. As shown in the left hand side of FIG. 6, the conventional hose reel system lays hose 80 in a manner that is substantially behind the tractor pulling the hose reel system. However, in the right hand side of FIG. 6 the hose reel system 1000' of example embodiments allows hose to be laid offset from the spool 70 of the hose reel system 1000' allowing an operator in the tractor to better view the hose 80 being laid on the ground. In addition, the layout guide 300 may be especially useful for laying hose in a trench. In the conventional art hose must be laid next to a trench and then manually moved to the trench. In example embodiments the layout guide 300 may allow for hose to be directly laid in a ditch.

In example embodiments, the hose reel systems 1000 and 1000' may be also be augmented with remote control and/or speed control systems. The systems, for example, may be configured to control a rate at which hose is unwound from the spools 70. For example, in the conventional art, hydraulic systems have to be manipulated or vehicle speeds have to be adjusted when hose is laid out in order to promote efficient hose layout. In example embodiments, however, sensors may be placed on the spools 70 and 70' and the frames and a controller may be configured to automatically control a speed at which the driving members 60 operate. For example, as the hose 80 is being unwound from the spools 70 the rotational speed of the spools 70 may need to be increased in order to promote a constant layout of hose 80. In one embodiment, sensors may be placed on or near the spools 70 and on or near the frames in order to detect how much hose is wrapped on the spools 70 and how fast the hose reel systems 1000 and 1000' are traveling. A controller may then use this data to control the driving members 60 of the hose reel systems 1000 and 1000' in order to promote an efficient hose layout. The system may be further enhanced by the use of global positioning technology which may include a GPS speed sensor with an encoder on the spool.

Figure 7A:
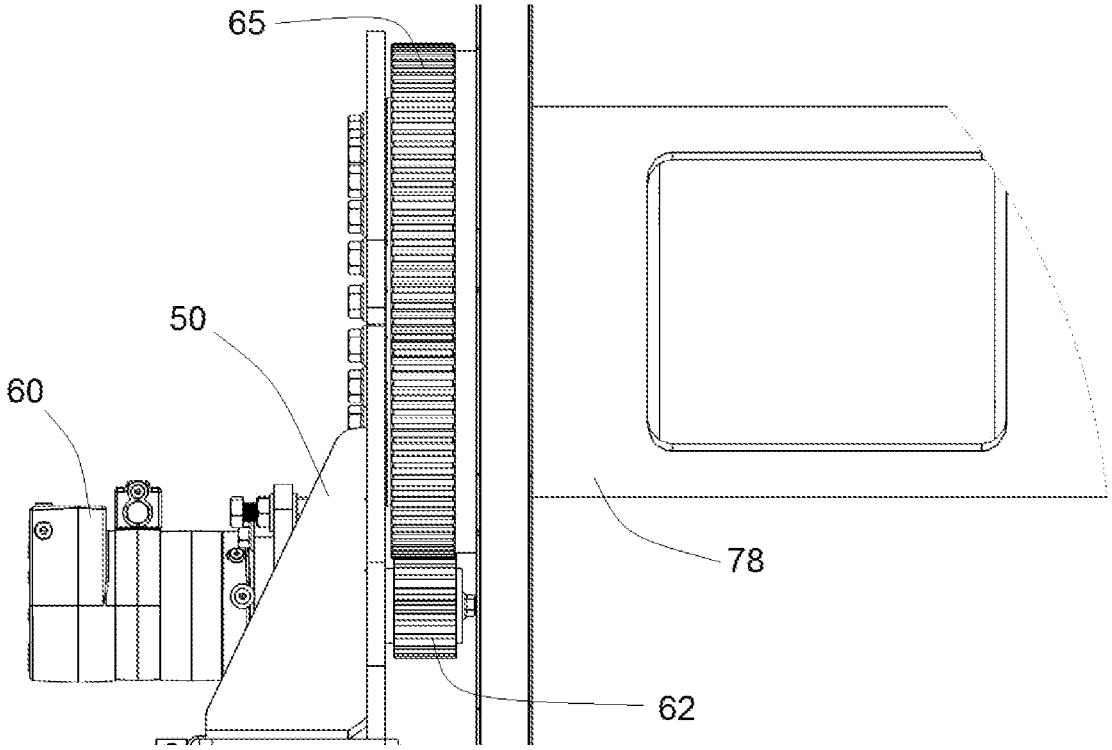
FIGS. 7A and 7B are views of a direct drive motor and a slewing ring which may be at each side of a spool in accordance with example embodiments.
Figure 7B:
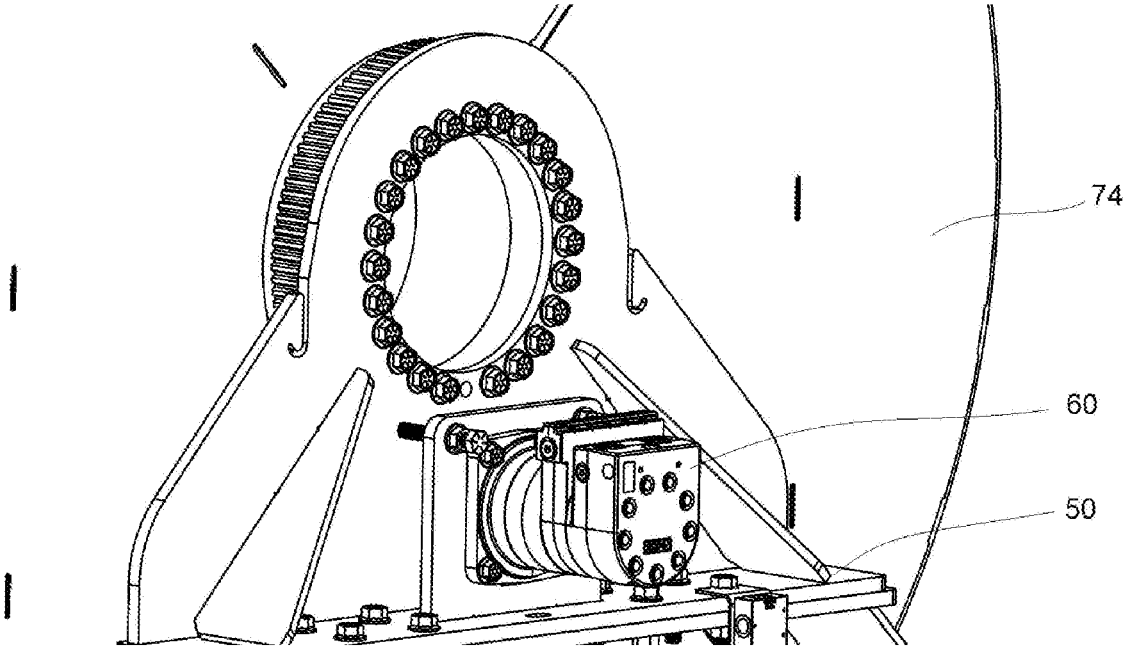

FIGS. 7A and 7B are close up views of the driving member 60. As shown in FIGS. 7A and 7B, the driving member 60 may be attached to the support members 50 of the frame 10. The actual attachment may be conventional in nature. For example, bolting, welding, clipping, and/or screwing may be appropriate methods for attaching the driving member to the support members 50. In at least one example embodiment the driving member 60 may be a variable speed (for example, two speed) hydraulic motor having a shaft with a gear 62, for example, a pinion gear, arranged at an end thereof. Thus, as the shaft of the driving member 60 turns, the gear 62 likewise turns. The pinion 62 may interface with a slewing ring 65 which may be operatively attached to the shaft 78. Thus, as the driving member 60 operates, gear 62 rotates causing the slewing ring 65 which in turn causes the spool 70 to rotate enabling the spool 70 to collect hose 80. In at least one embodiment, the gear 62 directly interfaces with the slewing ring 65 to rotate the slewing ring 65. In addition, the slewing ring 65 may be, but is not required to be, directly attached to the spool 70 by welding, bolting, clipping, or some other conventional method. On the other hand, an intermediate member, for example, a plate, may be arranged between the spool 70 and the slewing ring 65.

Also, in example embodiments, it is understood that various attributes associated with either one of the hose reel systems 1000 and 1000' may be implemented in the other.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What I claim is:

1. A mobile hose reel system comprising:
- a frame;
- an axle rotationally attached to the frame;
- a pair of wheels attached to the axle;
- a spool rotationally attached to the frame;
- a driving member configured to rotate the spool;
- a tongue pivotally attached to the frame;
- a first actuator configured to pivot the tongue with respect to the frame;
- a hose guide arranged in front of the spool, the hose guide being configured to control a loading of hose on the spool; and
- a second actuator configured to move the hose guide, wherein the hose guide is pivotally connected to the frame and the second actuator is configured to pivot the hose guide.

2. The mobile hose reel system of claim 1, wherein the hose guide is configured to move in a side-by-side manner to control a loading of hose on the spool.

3. The hose reel system of claim 1, wherein the tongue has a coupling member configured to couple to a towing vehicle.

4. The hose reel system of claim 3, wherein the hose guide is between the coupling member and the spool.

5. The hose reel system of claim 1, wherein the driving member includes a motor.

6. The hose reel system of claim 5, wherein the motor is a multispeed motor.

7. The hose reel system of claim 5, wherein the motor is a hydraulic motor.

8. The mobile hose reel system of claim 1, wherein the driving member includes a motor and a slewing ring coupled to the motor.

9. The mobile hose reel system of claim 8, wherein the slewing ring is connected to a pinion of the motor.

10. A mobile hose reel system comprising:

a frame;

an axle rotationally attached to the frame;

a pair of wheels attached to the axle;

a spool rotationally attached to the frame;

a driving member configured to rotate the spool;

a tongue pivotally attached to the frame;

a first actuator configured to pivot the tongue with respect to the frame; and a hose guide arranged in front of the spool, the hose guide being configured to control a loading of hose on the spool, wherein the driving member includes a multi-speed motor and a slewing ring directly coupled to a pinion of the motor.

11. A mobile hose reel system comprising:

a frame;

an axle rotationally attached to the frame;

a pair of wheels attached to the axle;

a spool rotationally attached to the frame;

a driving member attached to the frame, the driving member being configured to rotate the spool;

a tongue pivotally attached to the frame;

a first actuator configured to pivot the tongue with respect to the frame; and a hose guide arranged at a front side of the spool and configured control a loading of hose on the spool; and a layout guide pivotally connected to the frame.

12. The mobile hose reel system of claim 11, wherein the hose guide is configured to move in a side-by-side manner.

13. The mobile hose reel system of claim 11, wherein, the layout guide includes an arm pivotally supported at a first end, the tongue has a coupling member configured to couple to a towing vehicle, and the first end of the arm is pivotally supported to allow the arm to pivot about at least one of a vertical and horizontal axis.

14. The hose reel system of claim 11, wherein the layout guide further includes a capture member configured to capture and guide a hose configured to provide manure to an agricultural field.

15. The hose reel system of claim 11, wherein the spool is generally between the hose guide and the layout guide.

16. The mobile hose reel system of claim 11, wherein the driving member includes a motor and a slewing ring coupled to the motor.

17. The mobile hose reel system of claim 16, wherein the slewing ring is connected to a pinion of the motor.

18. The mobile hose reel system of claim 11, further comprising:

a second actuator configured to move the hose guide.

19. The mobile hose reel system of claim 18, wherein the hose guide is pivotally connected to the frame and the second actuator is configured to pivot the hose guide.

* * * * *